US011174583B2

(12) United States Patent
Kim et al.

(10) Patent No.: US 11,174,583 B2
(45) Date of Patent: Nov. 16, 2021

(54) METHOD OF CONTROLLING LAUNDRY TREATING APPARATUS

(71) Applicant: LG Electronics Inc., Seoul (KR)

(72) Inventors: Sangyoung Kim, Seoul (KR); Sangho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 110 days.

(21) Appl. No.: 16/654,543

(22) Filed: Oct. 16, 2019

(65) Prior Publication Data

US 2020/0115842 A1 Apr. 16, 2020

(30) Foreign Application Priority Data

Oct. 16, 2018 (KR) ..... 10-2018-0123416

(51) Int. Cl.

| | |
|---|---|
| ***D06F 39/08*** | (2006.01) |
| ***D06F 39/10*** | (2006.01) |
| ***D06F 33/69*** | (2020.01) |
| ***D06F 58/45*** | (2020.01) |
| ***D06F 58/22*** | (2006.01) |
| ***D06F 58/24*** | (2006.01) |
| ***D06F 105/34*** | (2020.01) |
| ***D06F 105/36*** | (2020.01) |
| *D06F 58/20* | (2006.01) |

(52) U.S. Cl.

CPC ..... *D06F 39/087* (2013.01); *D06F 33/69* (2020.02); *D06F 39/10* (2013.01); *D06F 58/22* (2013.01); *D06F 58/24* (2013.01); *D06F 58/45* (2020.02); *D06F 58/20* (2013.01); *D06F 2105/34* (2020.02); *D06F 2105/36* (2020.02)

(58) Field of Classification Search

CPC ..... D06F 33/36; D06F 39/087; D06F 39/10; D06F 58/22; D06F 58/24; D06F 58/45; D06F 2105/34; D06F 2105/36

See application file for complete search history.

(56) References Cited

U.S. PATENT DOCUMENTS

2016/0115636 A1* 4/2016 Kim ..... D06F 39/10 68/18 F
2016/0115639 A1* 4/2016 Kim ..... D06F 58/22 34/82
2016/0115643 A1* 4/2016 Bison ..... D06F 58/24 34/468
2017/0191208 A1* 7/2017 Kim ..... D06F 58/22
(Continued)

*Primary Examiner* — Joseph L. Perrin
(74) *Attorney, Agent, or Firm* — Fish & Richardson P.C.

(57) ABSTRACT

The present disclosure provides a method of controlling a laundry treating apparatus including a tub in which a drum accommodating clothing is rotatably disposed, a heat exchanger configured to perform heat exchange between air discharged from the tub and a refrigerant in a circulation flow path through which the air circulates, a filter configured to filter the air, a first cleaning mechanism configured to apply cleaning water to any one of the filter and the heat exchanger, and a second cleaning mechanism configured to apply the cleaning water to the other of the filter and the heat exchanger. The method includes measuring a flow rate while supplying water into the tub, and controlling, based on the flow rate, a first flow path control valve for regulating water supply to the first cleaning mechanism and a second flow path control valve for regulating water supply to the second cleaning mechanism.

20 Claims, 5 Drawing Sheets

(56) References Cited

U.S. PATENT DOCUMENTS

| | | | | |
|---|---|---|---|---|
| 2017/0191209 | A1* | 7/2017 | Kim | D06F 33/00 |
| 2017/0191212 | A1* | 7/2017 | Yoon | D06F 58/20 |
| 2018/0245271 | A1* | 8/2018 | Bocchino | D06F 58/22 |
| 2018/0245272 | A1* | 8/2018 | Bocchino | D06F 58/22 |
| 2018/0245273 | A1* | 8/2018 | Bocchino | D06F 58/22 |
| 2018/0245274 | A1* | 8/2018 | Bocchino | D06F 58/24 |

* cited by examiner

METHOD OF CONTROLLING LAUNDRY TREATING APPARATUS

CROSS-REFERENCE TO RELATED APPLICATION

This application claims the benefit of priority to Korean Application No. 10-2018-0123416, filed on Oct. 16, 2018. The disclosure of the prior application is incorporated by reference in its entirety.

BACKGROUND OF THE INVENTION

Field of the Invention

The present disclosure relates to a method of controlling a laundry treating apparatus capable of cleaning a filter and a heat exchanger provided in a circulation flow path by applying cleaning water to the filter and the heat exchanger.

Related Art

A laundry treating apparatus having washing and drying functions is known. In a laundry treating apparatus of the related art, if laundry is put into a rotating drum installed in a tub and a predetermined course is selected, washing and drying (or a series of strokes including washing and drying) are performed according to the selected course.

Here, in a case of the washing, after cleaning water is supplied into the tub, the drum is rotated to remove contamination of the laundry. Moreover, in a case of the drying, the laundry is dried while air circulates along a drying flow path through the tub or drum.

The laundry treating apparatus has a heat pump for heating the circulating air flowing along the drying flow path, and the heat pump has a heat exchanger for performing heat exchange between a refrigerant and the circulating air. The heat exchanger comes into contact with the air, and thus, foreign matters are accumulated on the heat exchanger. Accordingly, a heat exchanger cleaning mechanism for applying cleaning water to remove the foreign matters is provided.

In addition, a filter for filtering foreign matters such as dust or lint suspended in the circulating air is provided in the drying flow path. In this case, a filter cleaning mechanism for applying the cleaning water to clean the filter is provided.

Meanwhile, when the cleaning water is intermittently injected (that is, when the injection is repeated at regular time intervals) by the heat exchanger cleaning mechanism or the filter cleaning mechanism, there is a problem that water hammering may occur when a valve for controlling supply of the cleaning water is closed.

Compared to when the injection is continuously performed for a predetermined time at a low water pressure, when opening and closing of the valve are repeated in a short cycle, an injection pressure increases when the valve is opened using the water pressure accumulated while the valve is closed, and thus, the cleaning is more effectively performed. This type of injection (or water supply) may be also performed on a control of the heat exchanger cleaning mechanism or the filter cleaning mechanism. However, in this method, there is a problem that noise due to water hammering is repeatedly generated in an environment where the water supply pressure is high.

SUMMARY OF THE INVENTION

The present disclosure provides a method of controlling a laundry treating apparatus capable of reducing a frequency of water hammer noise generated in a process of cleaning a filter and a heat exchanger.

The present disclosure also provides a method of controlling a laundry treating apparatus capable of predicting occurrence of water hammer noise in consideration of a pressure of water supplied to home and controlling water supply to clean the filter and the heat exchanger according to the prediction.

The present disclosure also provides a method of controlling a laundry treating apparatus capable of securing performance for cleaning the filter and the heat exchanger while reducing occurrence of water hammer.

The present disclosure provides a method of controlling a laundry treating apparatus. The laundry treating apparatus includes a tub in which a drum accommodating clothing is rotatably disposed, a heat exchanger configured to perform heat exchange between air discharged from the tub and a refrigerant in a circulation flow path through which the air circulates, a filter configured to filter the air, a first cleaning mechanism configured to apply cleaning water to any one of the filter and the heat exchanger, and a second cleaning mechanism configured to apply the cleaning water to the other of the filter and the heat exchanger.

The control method includes a flow rate measurement step of measuring a flow rate while supplying water into the tub, and a cleaning step of controlling, based on the flow rate, a first flow path control valve for regulating water supply to the first cleaning mechanism and a second flow path control valve for regulating water supply to the second cleaning mechanism.

In the cleaning step, when the flow rate is less than a preset reference flow rate, that is, when a water supply pressure is relatively low, a low pressure cleaning mode is performed. In addition, when the flow rate is equal to or more than the preset reference flow rate, that is, when the water supply pressure is relatively high, a high pressure cleaning mode is performed.

In the low pressure cleaning mode, opening and closing of the second flow path control valve are performed a plurality of times after opening and closing of the first flow path control valve are performed a plurality of times.

In the high pressure cleaning mode, the first flow path control valve is closed after the first flow path control valve is opened during a preset first time, and thereafter, the second flow path control valve is closed after the second flow path control valve is opened during a preset second time.

An opening time of the first flow path control valve in the high pressure cleaning mode may be longer than a one-time opening time of the first flow path control valve in the low pressure cleaning mode.

An opening time of the second flow path control valve in the high pressure cleaning mode is longer than a one-time opening time of the second flow path control valve in the low pressure cleaning mode.

In the high pressure cleaning mode, the second flow path control valve may be opened before the first flow path control valve is closed. In the high pressure cleaning mode, each of the first flow path control valve and the second flow path control valve may be opened once.

The first cleaning mechanism may be configured to apply the cleaning water to the filter, and in the low pressure cleaning mode, a one-time closing time of the first flow path control valve may be shorter than a one-time closing time of the second flow path control valve. In the low pressure cleaning mode, the number of times the opening and closing of the first flow path control valve are repeated may be smaller than the number of times the opening and closing of the second flow path control valve are repeated.

The first cleaning mechanism may be configured to apply the cleaning water to the filter. In the high pressure cleaning mode, an opening time of the first flow path control valve may be longer than an opening time of the second flow path control valve.

In the high pressure cleaning mode, the opening time of the first flow path control valve may be two times or more the opening time of the second flow path control valve.

The present disclosure also provides a method of controlling a laundry treating apparatus. The method includes a flow rate measurement step of measuring a flow rate while supplying water into the tub; and a cleaning step of controlling, based on the flow rate, a first flow path control valve for regulating water supply to the first cleaning mechanism and a second flow path control valve for regulating water supply to the second cleaning mechanism.

In the cleaning step, if the flow rate is less than a preset reference flow rate, a low pressure cleaning mode is performed, and if the flow rate is equal to or more than the preset reference flow rate, a high pressure cleaning mode is performed.

The low pressure cleaning mode includes a step in which opening and closing of the second flow path control valve are repeated a plurality of times after opening and closing of the first flow path control valve are repeated a plurality of times.

The high pressure cleaning mode includes a step in which when the first flow path control valve is closed after being opened during a predetermined time, which is repeated, the second flow path control valve is opened before the first flow path control valve is closed after the first flow path control valve is opened, and the second flow path control valve is closed before the first flow path control valve is opened again.

In the high pressure cleaning mode, the closing of the first flow path control valve may be performed in a state where the second flow path control valve is opened. In the high pressure cleaning mode, a one-time opening time of the second flow path control valve may be longer than a one-time closing time of the first flow path control valve.

DESCRIPTION OF EXEMPLARY EMBODIMENTS

Figure 1:
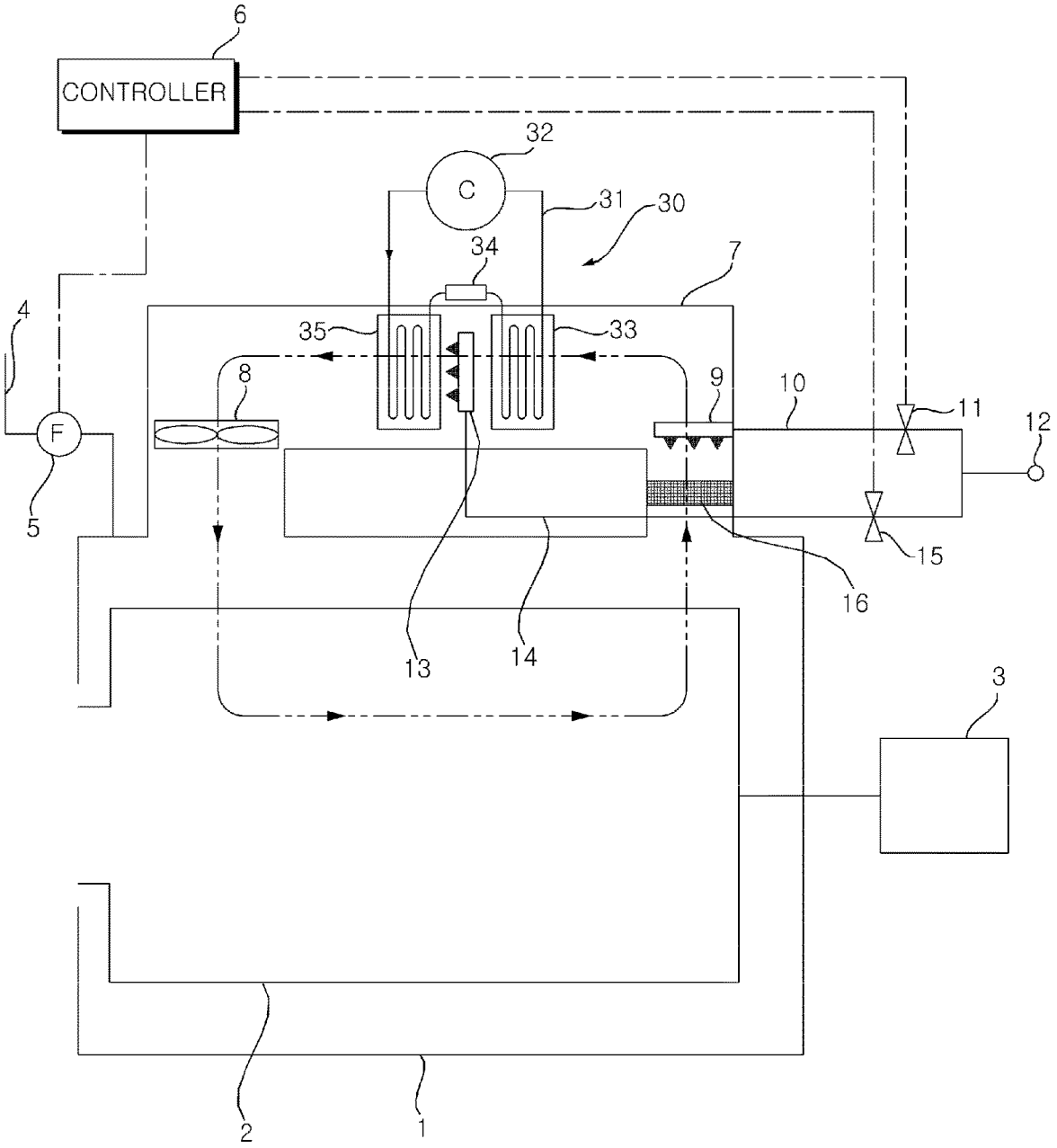
FIG. 1 is a configuration diagram of a laundry treating apparatus according to an embodiment of the present disclosure.
Figure 2:
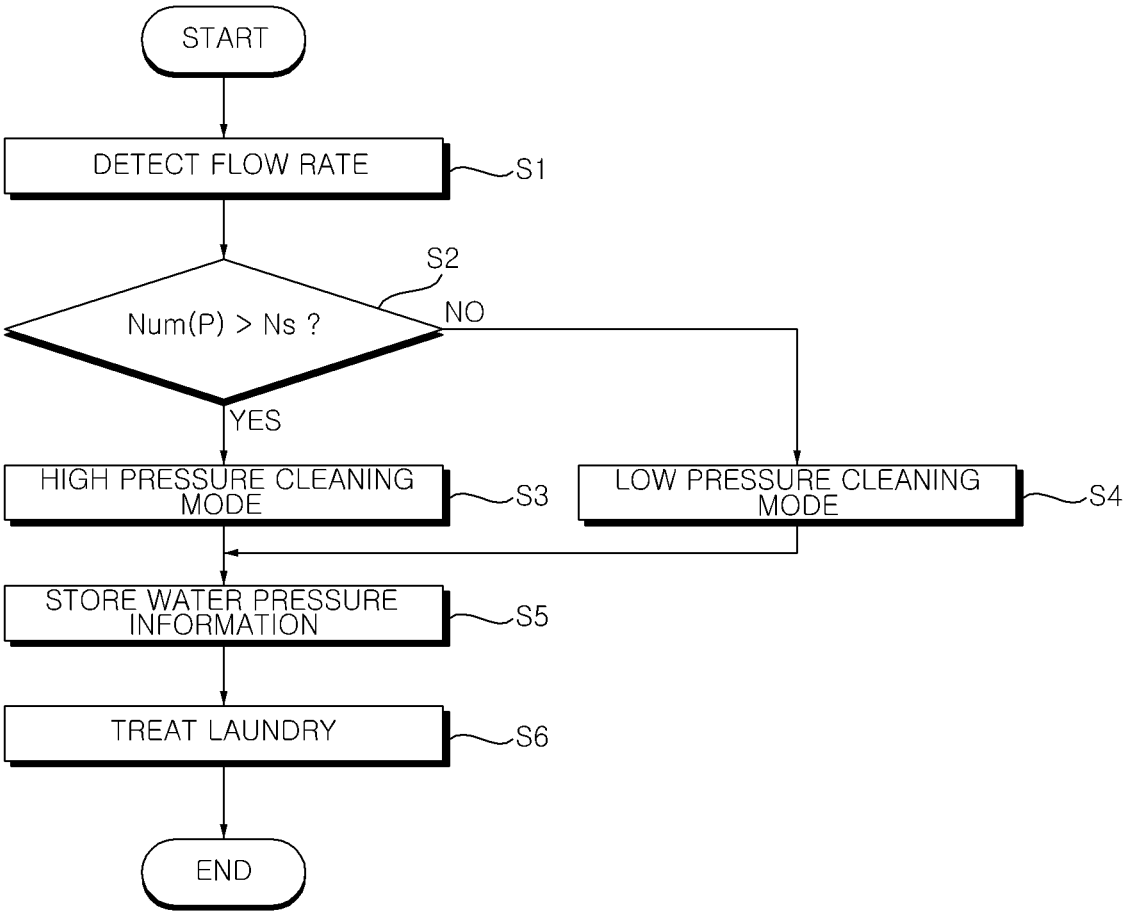
FIG. 2 is a flowchart illustrating a method of controlling a laundry treating apparatus according to an embodiment of the present disclosure.
Figure 3A:
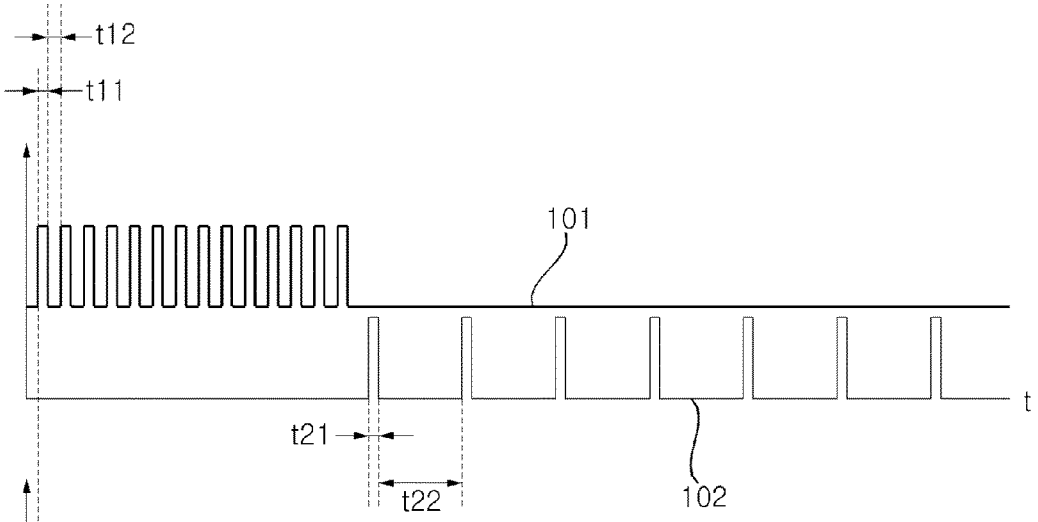
FIG. 3A is a graph showing a control of a water supply valve in a low pressure cleaning mode and FIG. 3B is a graph showing a control of the water supply valve in a high pressure cleaning mode.
Figure 3B:
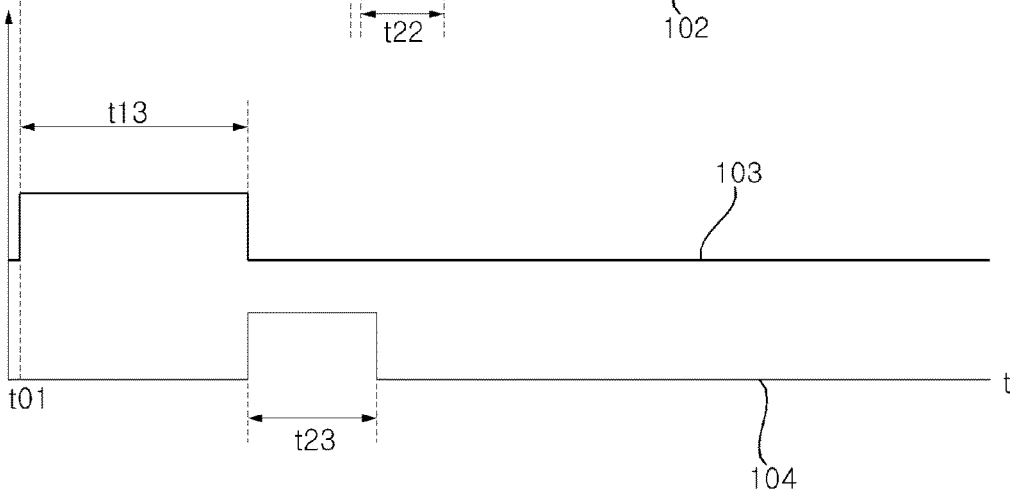
Figure 4:
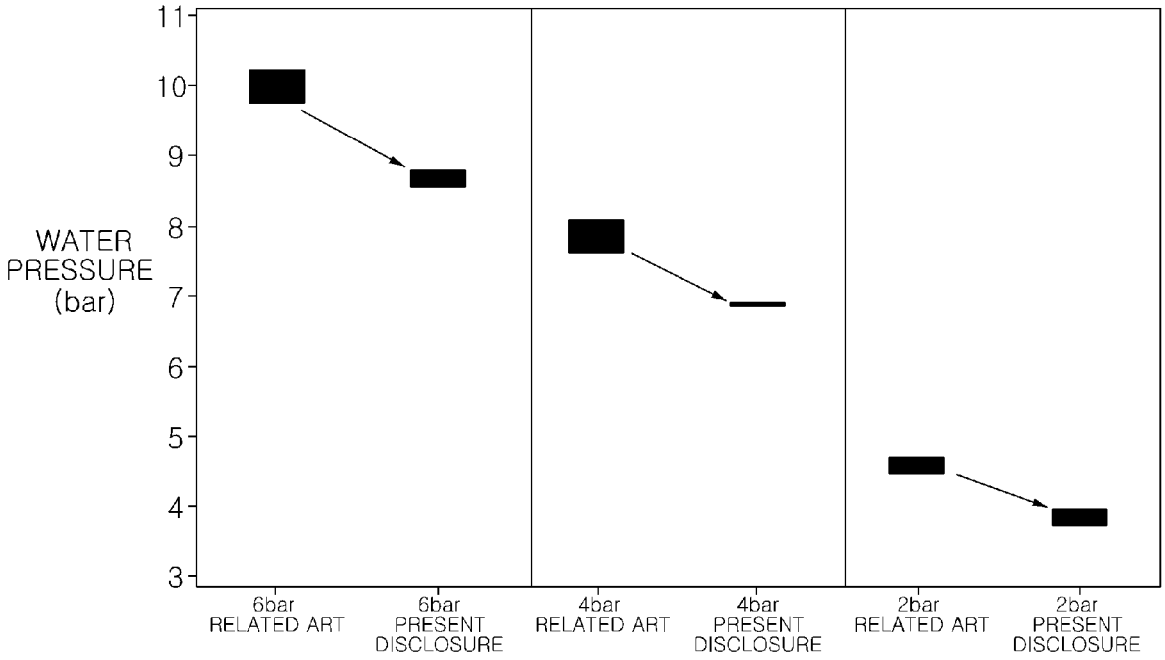
FIG. 4 is a graph comparing a water pressure of the present disclosure with a water pressure of the related art in the high pressure cleaning mode.

FIG. 1 is a configuration diagram of a laundry treating apparatus according to an embodiment of the present disclosure. FIG. 2 is a flowchart illustrating a method of controlling a laundry treating apparatus according to an embodiment of the present disclosure. FIG. 3A is a graph showing a control of a water supply valve in a low pressure cleaning mode and FIG. 3B is a graph showing a control of the water supply valve in a high pressure cleaning mode. FIG. 4 is a graph comparing a water pressure of the present disclosure with a water pressure of the related art in the high pressure cleaning mode.

With reference to FIG. 1, a laundry treating apparatus according to an embodiment of the present disclosure includes a tub 1 which forms a predetermined space and a drum 2 which is rotatably provided in the tub 1 and accommodates clothing. The laundry treating apparatus may include a motor 3 which rotates the drum 2.

Air discharged from the tub 1 circulates through a circulation flow path 7, and heat exchangers 33 and 35 which performs heat exchange between air and a refrigerant and a filter 16 which filters the air are provided in the circulation flow path 7. Moreover, a first cleaning mechanism 9 which applies cleaning water to any one of the filter 16 and the heat exchangers 33 and 35, and a second cleaning mechanism 13 which applies the cleaning water to the other of the filter 16 and the heat exchangers 33 and 35 are provided.

The circulation flow path 7 constitutes a conduit (or flow path) which extends from an inlet to an outlet, the inlet communicates with the tub 1 at a predetermined point, and the air discharged from the tub 1 flows into the inlet. Moreover, the outlet communicates with the tub 1 at another point, and the air guided through the circulation flow path 7 is discharged to the tub 1 again. A blowing fan 8 for blowing the air (or flow) may be provided in the circulation flow path 7.

The heat exchangers 33 and 35 which perform the heat exchange between the air and the refrigerant may be provided in the circulation flow path 7. The heat exchangers 33 and 35 constitute a heat pump 30 and may be any one of an evaporator 33 for cooling the air or a condenser 35 for heating the air. More specifically, the heat pump 30 constitutes a series of circulation cycle in which the refrigerant in a refrigerant pipe 31 is compressed, condensed, expanded, and evaporated while passing through a compressor 32, the condenser 35, an expander 34, and the evaporator 33.

The condenser 35 and the evaporator 33 may be disposed in the circulation flow path 7, and preferably, the evaporator 33 is disposed on an upstream side (arrows in two-dot chain line in FIG. 1 indicate a direction of air flow) of the condenser 35. While the air flows through the evaporator 33, moisture is condensed and dried. Accordingly, after that, the air heated by the condenser 35 is dried at a high temperature. That is, the evaporator 33 is a cooler for condensing the moisture in the air, and the condenser 35 is a heater for heating the air.

If the blowing fan 8 is operated and the air flows along the circulation flow path 7, the air discharged from the tub 1 is filtered while passing through the filter 16, and thereafter, while the air passes through the evaporator 33, the moisture contained in the air is condensed on a surface of the cool evaporator 33. This condensed water (hereinafter, referred to as condensate) flows along the circulation flow path 7, and the condensate may flow into the tub 1 again (in this case, the circulation flow path 7 needs to be connected to the tub 1 at an appropriate point so that the condensate is recovered directly into the tub 1 without being drained into the drum 2) or may be discharged to the tub 1 or a water container (not shown) through a condensate recovery flow path formed separately.

The filter 16 for collecting foreign matters such as dust or lint suspended in the air flow is provided in the circulation flow path 7. The filter 16 may be disposed on an upstream side of the evaporator 33. The filter 16 may be formed of a mesh structure having a predetermined particle size through which air passes but the foreign matters do not pass.

The first cleaning mechanism 9 which applies the cleaning water to any one of the filter 16 and the heat exchangers 33 and 35, and the second cleaning mechanism 13 which applies the cleaning water to the other of the filter 16 and the heat exchangers 33 and 35 are provided. Hereinafter, for example, the "heat exchanger" is the evaporator 33 which is easily contaminated due to the moisture condensed on the surface and foreign matters adsorbed on the moisture of the two heat exchangers 33 and 35 constituting the heat pump 30. However, according to an embodiment, the "heat exchanger" may be the condenser 35. In addition, hereinafter, the mechanism applying the cleaning water to the filter 16 is referred to as the first cleaning mechanism 9, and the mechanism applying the cleaning water to the heat exchanger (evaporator 33) is referred to as the second cleaning mechanism 13.

A first supply flow path 10 through which water is supplied to the first cleaning mechanism 9 and a first flow path control valve 11 for regulating the first supply flow path 10 may be provided. The first supply flow path 10 may be connected to an external water source (for example, a faucet connected to a domestic water pipe).

The first cleaning mechanism 9 may include a first nozzle which is connected to the first supply flow path 10 so as to inject (spray) water supplied through the first supply flow path 10. The first nozzle may inject the cleaning water toward the filter 16.

The first cleaning mechanism 9 is disposed on a downstream side of the filter 16 and injects the cleaning water toward the upstream side on which the filter 16 is located. The injected cleaning water is guided along the circulation flow path 7, is collected in the tub 1, and thereafter, can be drained to the outside of the laundry treating apparatus by a drainage mechanism.

A second supply flow path 14 through which water is supplied to the second cleaning mechanism 13 and a second flow path control valve 15 for regulating the second supply flow path 14 may be provided. The second supply flow path 14 may be connected to an external water source (for example, a faucet connected to a domestic water pipe).

The second cleaning mechanism 13 may be configured in substantially the same manner as the above-described first cleaning mechanism 9. The second cleaning mechanism 13 may be disposed on a downstream side of the evaporator 33 and inject the cleaning water toward the upstream side on which the evaporator 33 is located. The injected cleaning water is guided along the circulation flow path 7, is collected in the tub 1, and thereafter, can be drained to the outside of the laundry treating apparatus by a drainage mechanism.

The first flow path control valve 11 and the second flow path control valve 15 are solenoid valves, and operations thereof may be controlled by a controller 6. In addition, the controller 6 may control various electric components constituting the laundry treating apparatus such as the motor 3, the compressor 32, the blowing fan 8, or the expander 34. For reference, dashed-dotted lines shown in FIG. 1 are control lines showing control signals transmitted and received by the controller 6.

A flow meter 5 measures a flow rate of the cleaning water supplied into the tub 1. The flow meter 5 may be provided in a water supply flow path 4 for supplying the cleaning water. The water supply flow path 4, the first supply flow path 10, and the second supply flow path 14 may be connected to a common water source 12. The flow rate measured by the flow meter 5 may be input to the controller 6, and the controller 6 may control the first flow path control valve 11 and the second flow path control valve 15 based on the input flow rate.

Specifically, the controller 6 may control the operation of at least one of the first flow path control valve 11 and the second flow path control valve 15 in a cleaning mode to clean at least one of the filter 16 and the evaporator 33. The cleaning mode may be performed by a user's command input through a control panel. Alternatively, the cleaning mode may be automatically performed under the control of the controller 6 every predetermined period or every predetermined cycle (the number of operations of the laundry treating apparatus) according to a pre-programmed algorithm, or when a predetermined condition is satisfied (that is, when clogging of the filter 16 is detected, when a flow rate in the circulation flow path 7 is reduced, or the like). The cleaning mode will be described in more detail below with reference to FIGS. 3A and 3B.

In addition, the laundry treating apparatus according to the embodiment of the present disclosure may include configurations such as a water supply mechanism for supplying the cleaning water into the tub 1, a drainage mechanism for draining the cleaning water from the tub 1, and a control panel for receiving various control commands from the user. The configurations are already well known in the art of the laundry treating apparatus (for example, washing machine, drying machine, washing/drying machine) (for example, Patent Publication No. 10-2017-0082057) and are obvious to a person skilled in the art, and thus, descriptions thereof will be omitted.

Referring to FIG. 2, the method of controlling the laundry treating apparatus according to an embodiment of the present disclosure includes a cleaning step (cleaning mode) of controlling, based on a flow rate, the first flow path control valve 11 for regulating water supply to the first cleaning mechanism 9 and the second flow path control valve 15 for regulating water supply to the second cleaning mechanism 13. The flow rate may be measured by the flow meter 5, but is not necessarily limited thereto. That is, the flow rate may be measured using a water level sensor for detecting a water level in the tub 1. For example, the flow rate may be determined based on how much the water level in the tub 1 increases during a set time.

In the embodiment, Step S1 is a step of detecting the flow rate, water is supplied through the water supply flow path 4, and in this case, the flow rate is detected by the flow meter 5. The flow meter 5 may have an impeller (not shown) which is rotated by a water flow guided along the water supply flow path 4, and a rotational speed of the impeller is input to the controller 6.

The controller 6 sets the cleaning mode based on the flow rate obtained in Step S1. Specifically, the controller 6 compares a rotational speed Num (P) of the impeller of the flow meter 5 with a set value Ns, and according to the comparison result, sets the cleaning mode to any one of a high pressure cleaning mode S3 and a low pressure cleaning mode S4 (S2).

If the flow rate is less than a predetermined reference flow rate (that is, if Num (P)<Ns), the low pressure cleaning mode is performed. As shown in FIG. 3A, in the low pressure cleaning mode, opening and closing of the first flow path control valve 11 are repeated a plurality of times, and thereafter, opening and closing of the second flow path control valve 15 are repeated a plurality of times. Specifically, opening the first flow path control valve 11 for a preset opening time t11 from t=t01 and then closing the first flow path control valve 11 for a preset closing time t12 are performed a plurality of times by the controller 6. Since a water pressure in the flow path accumulates (increases) during the closing time of the first flow path control valve 11, there is an effect of increasing an injection water pressure when the first flow path control valve 11 is opened.

In the low pressure cleaning mode, after cleaning of the filter 16 by the first cleaning mechanism 9 is completed, cleaning of the evaporator 33 is performed using the second cleaning mechanism 13. That is, in a state in which the first cleaning mechanism 9 is closed, the controller 6 controls the opening and closing of the second flow path control valve 15 to be repeated a plurality of times. Thereafter, opening the second flow path control valve 15 for a preset opening time t21 and then closing the second flow path control valve 15 for a preset closing time t22 are repeated a plurality of times by the controller 6. The closing time t22 of the second flow path control valve 15 may be greater than the closing time t12 of the first flow path control valve 11.

In the low pressure cleaning mode, the water supply pressure is low, and thus, noise caused by water hammering is not significant. Accordingly, increasing the injection pressure and improving cleaning power by dividing a set time and repeating the opening and closing a plurality of times rather than continuously opening the first flow path control valve 11 (or second flow path control valve 15) during the set time are more important than reducing the water hammer noise.

Meanwhile, in the low pressure cleaning mode, the number of times the opening and closing of the first flow path control valve 11 are repeated may be less than the number of times opening and closing of the second flow path control valve 15 are repeated.

If the flow rate is equal to or more than the preset reference flow rate (that is, if Num (P)≥Ns), the high pressure cleaning mode is performed (refer to FIG. 3B). In the high pressure cleaning mode, the first flow path control valve 11 is closed after being opened for a preset first time t13. Thereafter, the second flow path control valve 15 is closed after being opened for a preset second time t23.

Here, preferably, the first time t13 is larger than a one-time opening time t11 of the first flow path control valve 11 in the low pressure cleaning mode. Furthermore, t13 may be equal to or larger than a total opening time (that is, the sum of the opening times t11 each time) of the first flow path control valve 11 in the low pressure cleaning mode.

Similarly, the second time t23 is larger than a one-time opening time t21 of the second flow path control valve 11 in the low pressure cleaning mode. Furthermore, t23 may be equal to or larger than a total opening time (that is, the sum of the opening times t21 each time) of the second flow path control valve 15 in the low pressure cleaning mode.

In the high pressure cleaning mode, the water supply pressure is high, and thus, the water hammer noise may be large. However, the water hammer noise occurs only when the first flow path control valve 11 is closed and the second flow path control valve 15 is closed.

Furthermore, by opening the second flow path control valve 15 when the first flow path control valve 11 is closed or opening the second flow path control valve 15 in advance before the first flow path control valve 11 is closed, it is possible to prevent the water hammer noise from being generated when the first flow path control valve 11 is closed, and in this case, the water hammer noise may be generated only once when the second flow path control valve 15 is closed.

In particular, similarly to the low pressure cleaning mode, even in the high pressure cleaning mode, if the opening and closing of the first flow path control valve 11 (or the second flow path control valve 15) are repeated, the water hammer noise also repeatedly occurs due to the high water pressure. However, according to an experiment, when the water pressure is equal or more than a certain level, it is found that a difference between an injection pressure when the opening and closing of the flow path control valves 11 and 15 are repeatedly performed and an injection pressure when the flow path control valves 11 and 15 are continuously opened as in the embodiment is not large. For this reason, in the high pressure cleaning mode, even if the injection is continuously performed for a certain time in the cleaning mechanisms 9 and 13, while sufficient cleaning power can be secured, the occurrence frequency of the water hammer noise can be reduced compared to the case where the opening and closing of the flow path control valves 11 and 15 are repeated.

In particular, in FIG. 4, when the water supply pressures are 2 bar, 4 bar, and 6 bar, the water pressures applied to the first supply flow path 10 in a pattern of the related art (that is, a pattern in which opening the first flow path control valve 11 during t11 and closing the first flow path control valve 11 during t12 are repeated as in the low water pressure mode) in which the opening and closing of the first flow path control valve 11 are repeated and the water pressures when the first flow path control valve 11 is continuously opened as in the embodiment are compared to each other. As a result, in the case of the embodiment, there is a decrease in the water pressure of approximately 13% at 6 bar, approximately 13% at 4 bar, and approximately 18% at 2 bar.

Meanwhile, in the high pressure cleaning mode, the opening time t13 of the first flow path control valve 11 may be longer than the opening time t23 of the second flow path control valve 15. Preferably, the opening time t13 of the first flow path control valve 11 is two times or more the opening time t23 of the second flow path control valve 15. However, the present disclosure is not necessarily limited thereto.

Meanwhile, information on the flow rate and the water pressure detected in Step S1 in FIG. 2 may be stored in a storage medium such as a memory (S5), and the controller 6 may control the operation of the laundry treating apparatus based on the stored information (S6). For example, in Step S6, the controller 6 may control a water supply time of the cleaning water based on the information on the flow rate or the water pressure.

Figure 5:
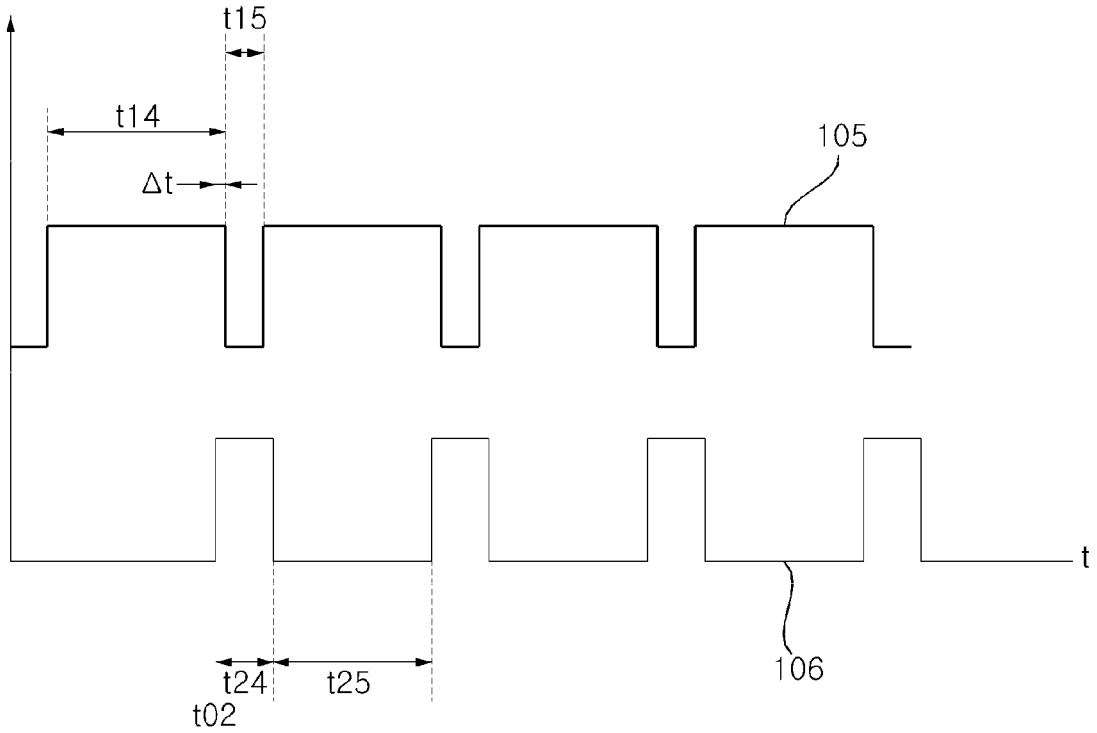
FIG. 5 is a graph showing a control of a water supply valve in a high pressure cleaning mode according to another embodiment of the present disclosure.

FIG. 5 is a graph showing a control of a water supply valve in a high pressure cleaning mode according to another embodiment of the present disclosure. Hereinafter, the high pressure cleaning mode described with reference to FIG. 5 may be performed in Step S3 of FIG. 2.

In the high pressure cleaning mode, when the first flow path control valve is closed after being opened during a predetermined time t14, which is repeated, after the first flow path control valve 11 is opened, the second flow path control valve 15 is opened before the first flow path control valve 11 is closed, and the second flow path control valve 15 is closed before the first flow path control valve 11 is opened again.

More specifically, in the high pressure cleaning mode, the first flow path control valve 11 is closed after being opened during t14 by the controller 6. At this time, before a time when the first flow path control valve 11 is opened elapses t14 (that is, in FIG. 5, t=t02), the second flow path control valve 15 is opened. That is, as shown in FIG. 5, when Δt elapses after the second flow path control valve 15 is opened, the first flow path control valve 11 is closed.

When the first flow path control valve 11 is closed, the second supply flow path 14 is closed. Accordingly, the water pressure when the first flow path control valve 11 is closed is distributed to the second supply flow path 14, the increase in the water pressure of the first supply flow path 10 is reduced as much as the distribution of the water pressure, and thus, it is possible to reduce the water hammer noise caused by the closing of the first flow path control valve 11.

Meanwhile, in the high pressure cleaning mode, a one-time opening time t24 of the second flow path control valve 15 may be longer than a one-time closing time t15 of the first flow path control valve 11. In particular, t24 may be set such that the opened second flow path control valve 15 is closed after the closed first flow path control valve 11 is opened.

According to the method of controlling the laundry treating apparatus of the present disclosure, firstly, compared to the related art, it is possible to reduce a frequency of the water hammer noise generated in the process of cleaning the filter and the heat exchanger under a high water pressure environment.

Secondly, by controlling the water supply for cleaning the filter and the heat exchanger according to the pressure of the water supplied to a home, a sufficient injection pressure can be obtained not only in the high water pressure but also in the low water pressure.

Thirdly, the water supply pressure is obtained using the flow meter for measuring the flow rate of the supply water, and thus, a separate water pressure sensor is not necessary, which is economical.

What is claimed is:

1. A method of controlling a laundry treating apparatus comprising:

supplying, by a first cleaning device and to one of a filter or a heat exchanger of the laundry treating apparatus, cleaning water through a first flow path control valve disposed on a first flow path;

supplying, by a second cleaning device and to another one of the filter or the heat exchanger of the laundry treating apparatus, cleaning water through a second flow path control valve disposed on a second flow path;

measuring, by a flow meter of the laundry treating apparatus and in a flow rate measurement step, a flow rate while supplying cleaning water into a tub of the laundry treating apparatus; and based on the measured flow rate, controlling, in a cleaning step, the first flow path control valve for supplying cleaning water to the first cleaning device and the second flow path control valve for supplying cleaning water to the second cleaning device, wherein, based on the flow rate being less than a preset reference value, the controlling, in the cleaning step, comprises operating a low pressure cleaning mode by controlling the second flow path control valve to open and close a plurality of times after controlling the first flow path control valve to open and close a plurality of times, and wherein, based on the flow rate being equal to or more than the preset reference value, the controlling, in the cleaning step, comprises operating a high pressure cleaning mode by controlling the first flow path control valve to remain open for a preset first time and controlling the second flow path control valve to remain open for a preset second time after closing the first flow path control valve.

2. The method of claim 1, wherein the preset first time of opening the first flow path control valve in the high pressure cleaning mode is longer than a time of one opening among the plurality of openings of the first flow path control valve in the low pressure cleaning mode, and wherein the present second time of opening the second flow path control valve in the high pressure cleaning mode is longer than a time of one opening among the plurality of openings of the second flow path control valve in the low pressure cleaning mode.

3. The method of claim 1, wherein, in the high pressure cleaning mode, the second flow path control valve is opened before the closing of the first flow path control valve.

4. The method of claim 1, wherein, in the high pressure cleaning mode, each of the first flow path control valve and the second flow path control valve is opened once.

5. The method of claim 1, wherein the first cleaning device is configured to apply the cleaning water to the filter, and wherein, in the low pressure cleaning mode, a time of one closing among the plurality of closings of the first flow path control valve is shorter than a time of one closing among the plurality of closings of the second flow path control valve.

6. The method of claim 5, wherein, in the low pressure cleaning mode, the number of operations of the first flow path control valve is less than the number of operations of the second flow path control valve.

7. The method of claim 1, wherein, in the high pressure cleaning mode, the preset first time of opening the first flow path control valve is longer than the preset second time of opening the second flow path control valve.

8. The method of claim 7, wherein, in the high pressure cleaning mode, the preset first time of opening the first flow path control valve is two times or more longer than the preset second time of opening the second flow path control valve.

9. The method of claim 1, further comprising:

exchanging, by a heat exchanger, heat between air discharged from the tub and a refrigerant of the laundry treating apparatus in a circulation flow path through which the air circulates; and filtering, by a filter of the laundry treating apparatus, the discharged air.

10. A method of controlling a laundry treating apparatus comprising:

supplying, by a first cleaning device and to one of a filter and a heat exchanger of the laundry treating apparatus, cleaning water through a first flow path control valve disposed on a first flow path;

supplying, by a second cleaning device and to another one of the filter and the heat exchanger of the laundry treating apparatus, cleaning water through a second flow path control valve disposed on a second flow path;

measuring, by a flow meter of the laundry treating apparatus and in a flow rate measurement step, a flow rate while supplying cleaning water into a tub of the laundry treating apparatus; and based on the measured flow rate, controlling, in a cleaning step, the first flow path control valve for supplying cleaning water to the first cleaning device and the second flow path control valve for supplying cleaning water to the second cleaning device, wherein, based on the flow rate being equal to or more than the preset reference value, the controlling, in the cleaning step, comprises operating a high pressure cleaning mode by controlling the first flow path control valve and the second flow path control valve to open and close for a plurality of times, and wherein the controlling, in the cleaning step, comprises operating a high pressure cleaning mode by controlling the second flow path control valve to open before the closing of the first flow path control valve, and controlling the second flow path control valve to close after the opening of the first flow path control valve.

11. The method of claim 10, wherein the time of opening the second flow path control valve comprises the time of closing the first flow path control valve, in the high pressure cleaning mode.

12. A laundry treating apparatus comprising:

a first cleaning device configured to supply and to one of a filter or a heat exchanger of the laundry treating apparatus, cleaning water through a first flow path control valve disposed on a first flow path;

a second cleaning device configured to supply and to another one of the filter or the heat exchanger of the laundry treating apparatus, cleaning water through a second flow path control valve disposed on a second flow path;

a flow meter configured to measure, in a flow rate measurement step, a flow rate while supplying cleaning water into a tub of the laundry treating apparatus; and a controller configured to:

based on the measured flow rate, control, in a cleaning step, the first flow path control valve for supplying cleaning water to the first cleaning device and the second flow path control valve for supplying cleaning water to the second cleaning device, wherein, based on the flow rate being less than a preset reference value, the controlling, in the cleaning step, comprises operating a low pressure cleaning mode by controlling the second flow path control valve to open and close a plurality of times after controlling the first flow path control valve to open and close a plurality of times, and wherein, based on the flow rate being equal to or more than the preset reference value, the controlling, in the cleaning step, comprises operating a high pressure cleaning mode by controlling the first flow path control valve to remain open for a preset first time and controlling the second flow path control valve to remain open for a preset second time after closing the first flow path control valve.

13. The laundry treating apparatus of claim 12, wherein the preset first time of opening the first flow path control valve in the high pressure cleaning mode is longer than a time of one opening among the plurality of openings of the first flow path control valve in the low pressure cleaning mode, and wherein the present second time of opening the second flow path control valve in the high pressure cleaning mode is longer than a time of one opening among the plurality of openings of the second flow path control valve in the low pressure cleaning mode.

14. The laundry treating apparatus of claim 12, wherein, in the high pressure cleaning mode, the second flow path control valve is opened before the closing of the first flow path control valve.

15. The laundry treating apparatus of claim 12, wherein, in the high pressure cleaning mode, each of the first flow path control valve and the second flow path control valve is opened once.

16. The laundry treating apparatus of claim 12, wherein the first cleaning device is configured to apply the cleaning water to the filter, and wherein, in the low pressure cleaning mode, a time of one closing among the plurality of closings of the first flow path control valve is shorter than a time of one closing among the plurality of closings of the second flow path control valve.

17. The laundry treating apparatus of claim 16, wherein, in the low pressure cleaning mode, the number of operations of the first flow path control valve is less than the number of operations of the second flow path control valve.

18. The laundry treating apparatus of claim 12, wherein, in the high pressure cleaning mode, the preset first time of opening the first flow path control valve is longer than the preset second time of opening the second flow path control valve.

19. The laundry treating apparatus of claim 18, wherein, in the high pressure cleaning mode, the preset first time of opening the first flow path control valve is two times or more longer than the preset second time of opening the second flow path control valve.

20. The laundry treating apparatus of claim 12, further comprising:

a heat exchanger configured to exchange heat between air discharged from the tub and a refrigerant of the laundry treating apparatus in a circulation flow path through which the air circulates; and a filter configured to filter the discharged air.

* * * * *